US005402930A

United States Patent [19]

Storms et al.

[11] Patent Number: 5,402,930

[45] Date of Patent: Apr. 4, 1995

[54] HIGH QUALITY INEXPENSIVE PIZZA BOX

[75] Inventors: Brian H. Storms, Lakewood; David W. Spitz, Jamestown; Walter F. Mikus, East Aurora, all of N.Y.

[73] Assignee: Jamestown Container Corporation, Falconer, N.Y.

[21] Appl. No.: 28,591

[22] Filed: Mar. 22, 1993

Related U.S. Application Data

[63] Continuation-in-part of Ser. No. 860,482, Mar. 30, 1992, Pat. No. 5,234,158.

[51] Int. Cl.[6] ..... B65D 5/64

[52] U.S. Cl. ..... 229/125.28; 229/114; 229/120; 229/149; 229/906; 229/939

[58] Field of Search ..... 229/114, 120, 117.01, 229/125.28, 149, 150, 902, 906, 939

[56] References Cited

U.S. PATENT DOCUMENTS

| | | | |
|---|---|---|---|
| 1,771,760 | 7/1930 | MacLellan . | |
| 1,905,119 | 4/1933 | Newton . | |
| 2,071,949 | 2/1937 | Reich | 229/31 |
| 2,483,063 | 9/1949 | Ray | 92/51 |
| 2,533,773 | 12/1950 | De La Foret | 229/6 |
| 2,625,315 | 1/1953 | Fehrenkamp | 229/45 |
| 2,645,405 | 7/1953 | Dorfman | 229/38 |
| 2,736,486 | 2/1956 | Rabby | 229/43 |
| 2,970,742 | 2/1961 | Fleisig | 229/45 |
| 2,999,626 | 9/1961 | McDermott | 229/45 |
| 3,306,520 | 2/1967 | Allard | 229/45 |
| 3,307,768 | 3/1967 | Growney | 229/28 |
| 3,342,322 | 9/1967 | Weisner et al. | 206/46 |
| 3,539,089 | 11/1970 | Osberg | 229/27 |
| 3,726,470 | 4/1973 | Naylor | 229/52 |
| 3,809,305 | 5/1974 | Persson | 229/45 |
| 3,861,582 | 1/1975 | Bock | 229/45 |
| 3,973,721 | 8/1976 | Nakane | 229/120 |
| 4,260,060 | 4/1981 | Faller | 206/622 |
| 4,365,738 | 12/1982 | Densen | 229/23 R |
| 4,373,636 | 2/1983 | Hoffman | 206/551 |
| 4,441,626 | 4/1984 | Hall | 229/120 |
| 4,795,085 | 1/1989 | Wein | 229/41 B |
| 4,798,323 | 1/1989 | Platt | 229/115 |
| 4,801,077 | 1/1989 | Sweatt, III et al. | 229/113 |
| 4,923,113 | 5/1990 | Guijarro | 229/125.27 |
| 4,960,238 | 10/1990 | Lorenz | 229/125.29 |
| 4,995,557 | 2/1991 | Fremion | 229/125.29 |
| 5,052,559 | 10/1991 | Bressi, Jr. | 206/525 |
| 5,060,851 | 10/1991 | Lorenz | 229/125.29 |
| 5,071,062 | 12/1991 | Bradley et al. | 229/109 |
| 5,234,158 | 8/1993 | Storms et al. | 229/104 |

FOREIGN PATENT DOCUMENTS

| | | | |
|---|---|---|---|
| 2301440 | 9/1976 | France . | |
| 2356574 | 1/1978 | France . | |
| 911584 U | 4/1992 | Germany . | |
| 673633 | 3/1990 | Switzerland . | |
| 302849 | 12/1928 | United Kingdom . | |
| 751638 | 7/1956 | United Kingdom . | |
| 1057875 | 2/1967 | United Kingdom | 229/149 |

*Primary Examiner*—Gary E. Elkins

*Attorney, Agent, or Firm*—Hodgson, Russ, Andrews, Woods & Goodyear

[57] ABSTRACT

A pizza container having raised bottom wall portions for air circulation underneath a pizza. This allows single-face corrugated inserts to be eliminated for cost savings. A two-piece pizza container has lid tabs hingedly joined to the lid along respective hinge lines recessed inwardly from the respective lid edges, each tab being folded along a fold line which lies generally along the respective lid edge to define an insertion portion to be received in a cut-out in a base side wall between inner and outer portions of the side wall and a portion between the insertion portion and the hinge line which is movable to effect lifting and lowering movement of the insertion portion for more easily attaching the lid and with the height of the cut-out being reduced for more effective attachment. The base has outwardly sloping side walls, and the "spring" effect of the insertion portion against the respective outer side wall portion is provided to resist downward forces on the lid to thereby protect pizza in the box.

25 Claims, 4 Drawing Sheets

Fig. 1.
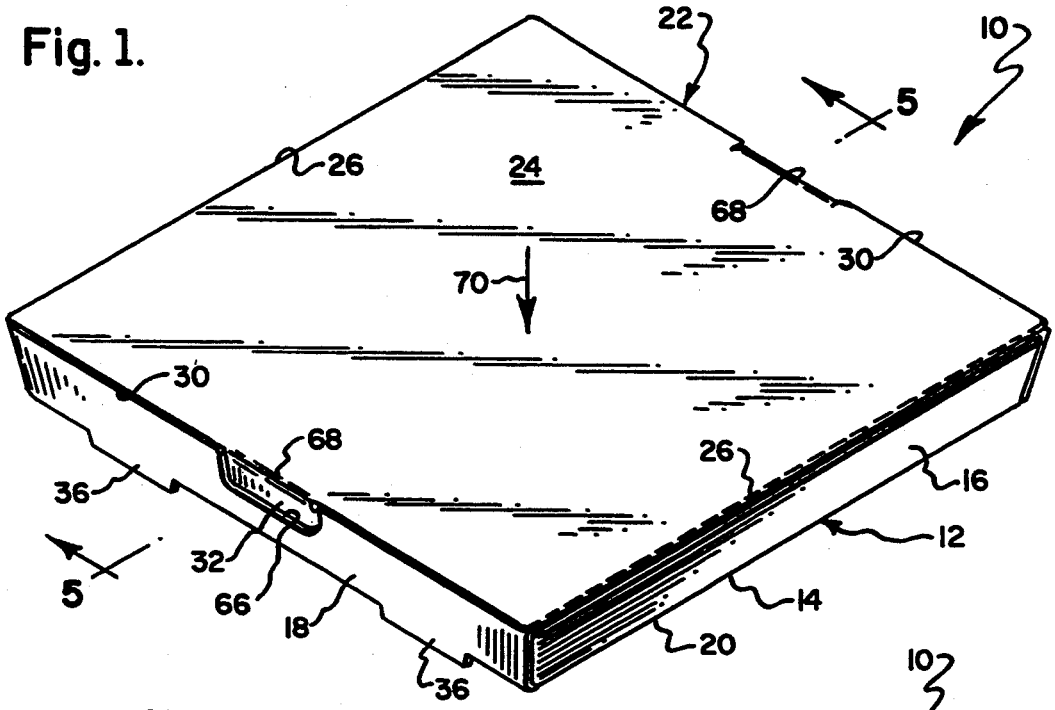
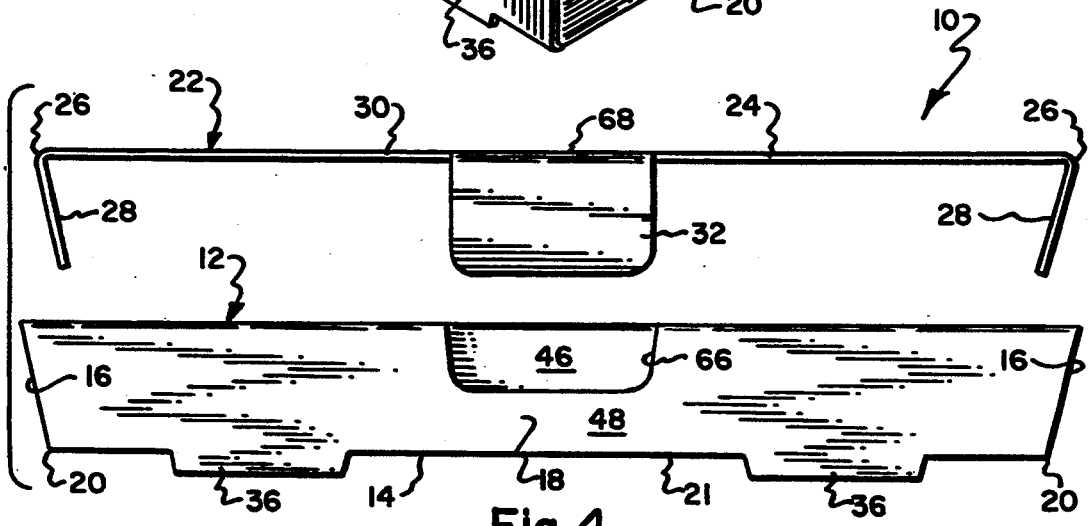
Fig. 4.
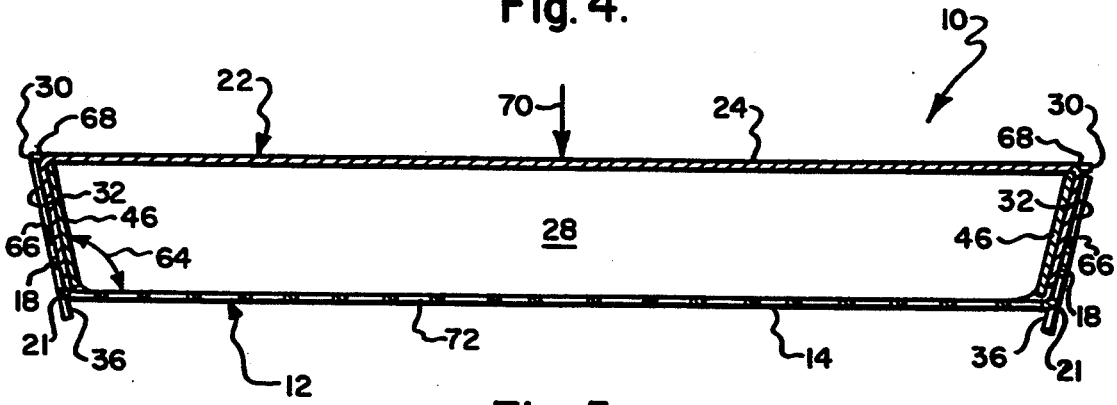
Fig. 5.

Fig. 8.
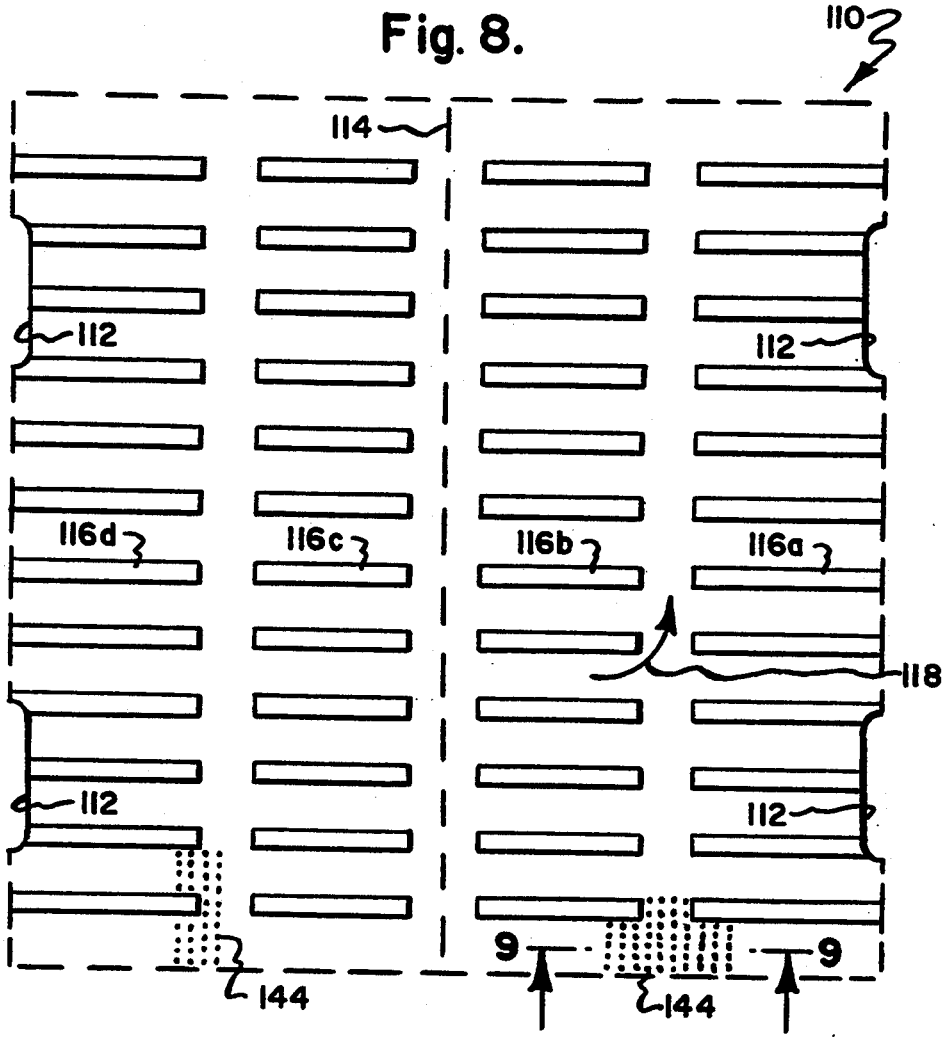
Fig. 9.
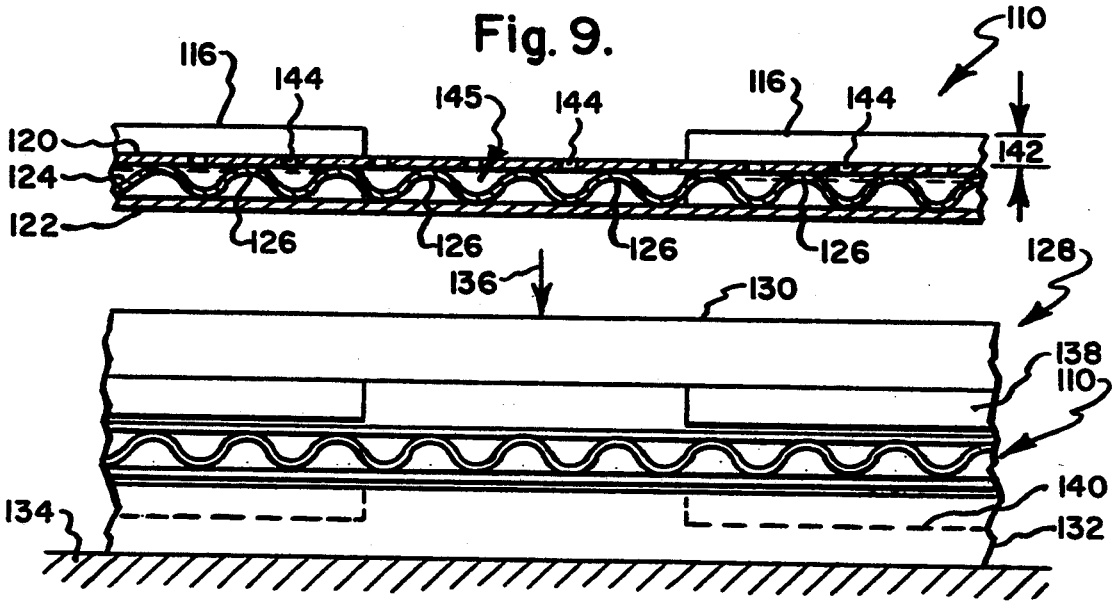
Fig. 10.

HIGH QUALITY INEXPENSIVE PIZZA BOX

This application is a continuation-in-part of U.S. patent application Ser. No. 07/860,482, filed Mar. 30, 1992, now U.S. Pat. No. 5,234,158, the disclosure of which is incorporated herein by reference.

The present invention relates generally to containers such as may be used as pizza boxes. However, it should be understood that the containers as described and claimed herein may be usable for other take-out foods or even for non-food items.

Pizza boxes have typically been constructed as a single piece from either thin cardboard or corrugated cardboard and with their side walls normal to the bottom wall, i.e., they do not slant with respect to the bottom wall. One of the side walls is folded so as to have an inner and an outer portion wherein the inner portion overlies the outer portion and has tabs along its terminal edge (an edge of the blank) to engage slots in the bottom wall, and flaps of the adjacent side walls are received between the inner and outer portions to form the box. The lid is integrally and foldably attached to the opposite side wall and has a tab which is inserted inwardly of the inner portion to close the box. Those pizza boxes which have been provided with slanting side walls have typically been provided with glue joints. An example of a single-piece pizza box is shown in U.S. Pat. No. 5,071,062 to Bradley et al.

U.S. Pat. Nos. 4,960,238 to Lorenz; 4,995,557 to Fremion; and 5,060,851 to Lorenz disclose two-piece boxes for pizza or other food products. Various other boxes are disclosed in U.S. Pat. Nos. 1,771,760; 1,905,0119; 2,071,949; 2,483,063; 2,625,315; 2,645,405; 2,736,486; 2,999,626; 3,307,768; 3,342,322; 3,539,089; 3,726,470; 3,809,305; 3,861,582; 4,365,738; 4,798,323; and 4,923,113; French patent document 2,301,440; British patent document 302,849 to Hunt; and Swiss patent document 673,633.

In order to provide a satisfactory two-piece pizza box, the box must be constructed so that the lid may be securely attached to the base so that it does not easily come loose therefrom and so that it may resist pressures on top of the lid which may otherwise deflect it so much that it undesirably bends inwardly to contact and perhaps ruin the pizza. It is also desirable that the base and the lid each be composed inexpensively of a single piece of cardboard which may be folded easily into shape without the use of glue or the like.

In addition to providing secure attachment of the lid to the base so as to resist pressures from on top of the lid, it is also desirable to be able to easily attach the lid.

Air circulation underneath a pizza is desired to keep moisture from condensing on the bottom of the pizza and the crust becoming mushy. In order to provide air circulation underneath a pizza, single-face corrugated inserts have traditionally been placed on the bottom wall of the pizza box to lie between the bottom wall and the pizza. Such inserts, which may cost perhaps 3 cents apiece, add substantially to the total cost of a pizza box.

It is accordingly an object of the present invention to eliminate the air circulation inserts yet continue to provide for air circulation beneath a pizza with the pizza boxes being manufactured at lower overall cost.

It is another object of the present invention to prevent or reduce the accumulation of grease condensation (grease droplets) onto the bottom of the pizza box and thereby improve the appearance thereof.

It is a further object of the present invention to provide a two-piece pizza box wherein blanks are easily folded to form it and wherein the lid may be tightly yet easily secured thereto and has sufficient capacity to resist downward pressure thereon which may cause the lid to contact and perhaps ruin a pizza therein.

It is another object of the present invention to provide such a pizza box which does not require glue or glued joints so as to reduce cost.

It is a further object of the present invention to provide such a pizza box wherein the assembled bases (trays) are nestable so as to minimize the space that a number of trays take up within a pizza shop.

It is yet another object of the present invention to provide such a pizza box wherein the trays may be easily folded up for disposal without unduly sacrificing the strength thereof.

It is still another object of the present invention to provide such a pizza box which is inexpensive to manufacture, easy to fold into the box shape on-site, yet rugged and providing adequate protection to a pizza therein.

In order to provide air circulation underneath a pizza box without the need for a single-face corrugated insert, in accordance with the present invention the bottom wall of a pizza container has a plurality of raised bottom wall portions. In order to prevent the unsightly accumulation of pizza vapor on the bottom of the pizza container, apertures (such as pin holes) are provided in the upper corrugated cardboard sheet of the bottom wall to thereby route the vapor to the space between the upper and lower corrugated cardboard sheets.

In accordance with the present invention, a two-piece pizza box has a lid with tabs on opposite edges for insertion in cut-outs in opposite side walls respectively of a base. Each tab is hingedly joined to the lid along a hinge line which is recessed inwardly from the respective edge. The tab is folded along a fold line which lies generally along or in line with the respective edge to define a portion for insertion in the respective cut-out and a portion which lies between the insertion portion and the hinge line and which is generally normal to the insertion portion. The hinged portion may thus be moved about the hinge line to effect vertical movement of the tab insertion portion into and out of the respective cut-out for more easily attaching the lid to the base. This also allows the cut-out height to be reduced for a more secure connection.

The side walls slope outwardly and the insertion portions interact therewith to effect a resistance to downward pressure on the lid so that the lid does not contact and perhaps ruin the pizza.

The above and other objects, features, and advantages of the present invention will be apparent in the following detailed description of the preferred embodiments when read in conjunction with the accompanying drawings wherein like reference numerals denote the same or similar parts throughout the several views.

BRIEF DESCRIPTION OF THE DRAWINGS

FIG. 1 is a perspective view of a container which embodies the present invention.

FIG. 4 is a side view of the container of FIG. 1 in position for insertion of the lid into the tray.

FIG. 5 s a sectional view of the container of FIG. 1 taken along lines 5—5 thereof.

FIG. 8 s a plan view of an alternative embodiment of the bottom wall of the container.

FIG. 9 is an enlarged partial section view of the bottom wall of FIG. 8 taken along lines 9—9 thereof.

FIG. 10 is a schematic view illustrating the making of a blank for a pizza box base having the bottom wall shown in FIG. 8.

DETAILED DESCRIPTION OF THE PREFERRED EMBODIMENTS

Figure 2:
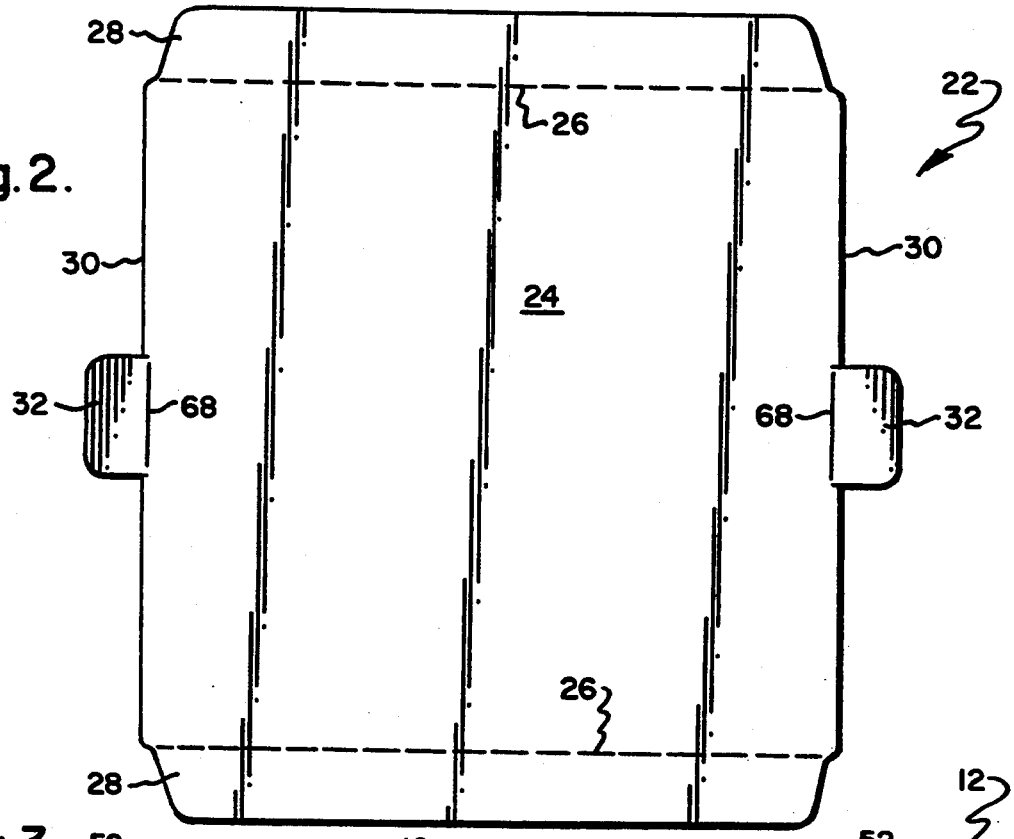
FIG. 2 is a plan view of a blank for the lid for the container of FIG. 1.

Referring to FIGS. 1, 4, and 5, there is shown generally at 10 a container for pizza or the like. The container 10 includes a tray or bottom member or base 12 having a bottom wall 14 which is of generally square shape for receiving pizza or other food or non-food product. A first pair of opposite side walls 16 and a second pair of opposite side walls 18 are integrally and foldably attached to respective edges 20 and 21 of the bottom wall 14 and extend upwardly therefrom. For example, each edge 20 and 21 of the bottom wall 14 may have a length of perhaps about 15 inches, and the height of each wall 16 and 18 may perhaps be about $1\frac{3}{4}$ inch.

The container 10 also includes a lid 22 having an upper wall 24 having dimensions slightly larger than those of the bottom wall 14 in order to completely cover the top of the tray 12. Lid 22 also has a first pair of opposite side walls 28 integrally and foldably connected to the upper wall 24 at opposite edges 26 thereof. The lid side walls 28 are provided to engage the inner surfaces of the first pair of tray side walls 16 for attachment of the lid 22 to the tray 12. A tab 32 is integrally and foldably attached to each of a second pair of opposite edges 30 of the upper wall 24 and is positioned generally centrally of the length of the corresponding edge 30. The tabs 32 engage cut-outs 66 in the second pair of side walls 18 to secure the lid 22 to the tray 12 as will be described in greater detail hereinafter.

In order to provide adequate strength for securely attaching the lid 22 to the tray 12 while also affording insulation to the container 10 so that pizza therein may remain warm for a longer period of time, the lid 22 and tray 12 are constructed of corrugated cardboard.

Figure 3:
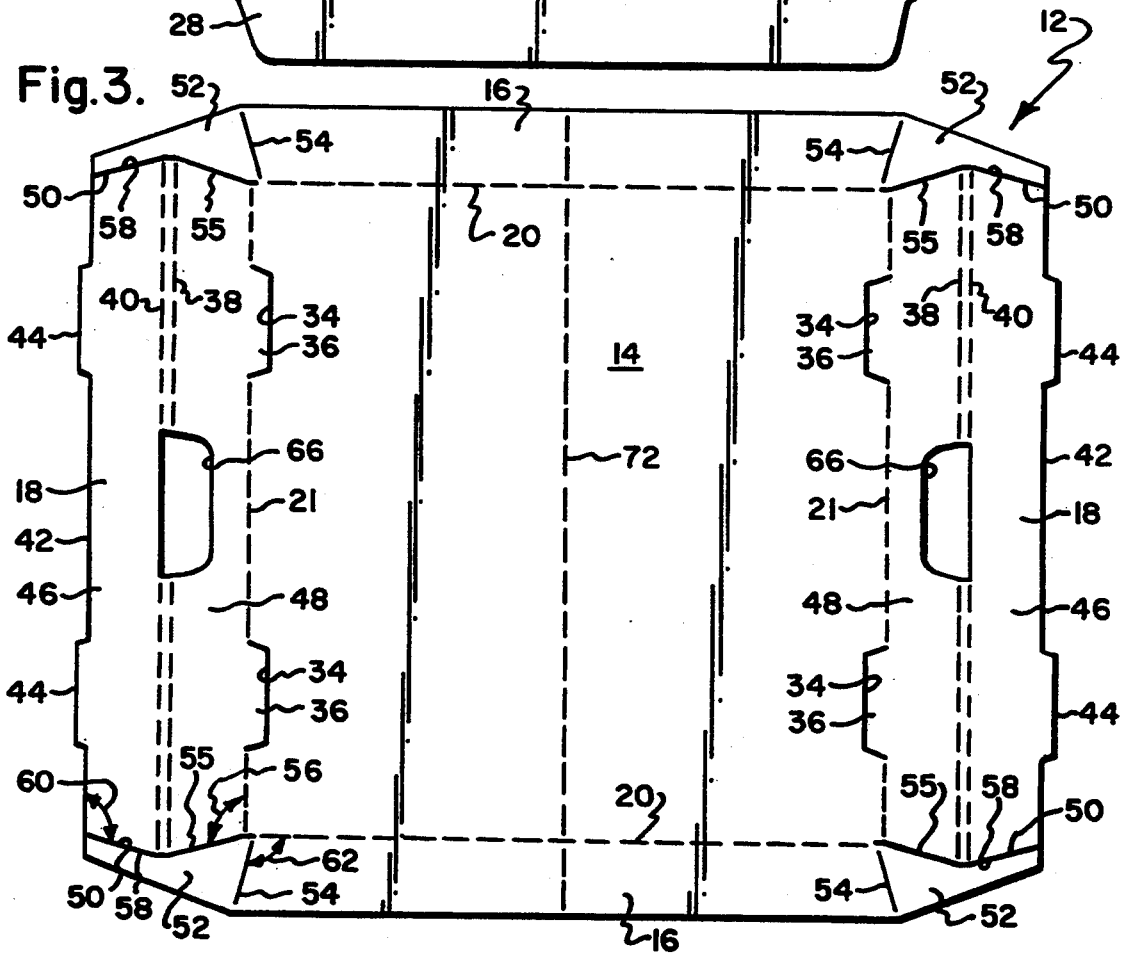
FIG. 3 is a plan view of a blank for the base or tray for the container of FIG. 1.

Referring to FIG. 3, the tray 12 is die-cut as a single piece from corrugated cardboard. The die-cutting operation includes the providing of crease lines and lines of perforations in the blank as hereinafter described. The blank 12 is perforated along each of the bottom wall edges 20 and 21. A pair of spaced three-sided cuts 34 are provided in the bottom wall 14 inwardly from each of the edges 21 to provide slots 34 in the bottom wall 14 when the second pair of side walls 18 are folded along edges 21 into an upstanding position. The edges 21 are not perforated along the lengths of the slots 34 so that when the second pair of side walls 18 are folded into an upstanding position, as shown in FIG. 4, the cut-outs 34 provide leg portions 36 on the side walls 18 which extend downwardly below the bottom wall 14 to act as legs for the tray whereby the bottom wall 14 may be raised slightly above a table top so as to prevent soak-through soiling of the table top. Each of the side walls 18 has a pair of closely spaced perforated lines 38 and 40 extending parallel to the respective edge 21 and centrally between the edge 21 and the terminal edge 42 thereof. A pair of tabs 44, corresponding in position and length to the slots 34, are provided along the terminal edge 42. Each of the second side walls 18 is folded about perforated lines 38 and 40 through an angle of 180° so as to provide an inner side wall portion 46 and an outer side wall portion 48 with the inner side wall portion 46 overlying the outer side wall portion 48 and the tabs 44 inserted in the slots 34 to secure the wall in an upstanding position.

The blank 12 is cut along lines 50 to provide end flaps 52 at each end of each of the first pair of side walls 16 and to define the end edges of each of the second pair of side walls 18. Thus, these end flaps 52 extend outwardly beyond the side walls 16. The side walls 16 are folded along creased but non-perforated lines 54 to form the end flaps 52 which are accordingly received between the inner and outer second side wall portions 46 and 48 respectively thereby allowing the blank 12 to be quickly and easily folded into the shape of a tray without the use of glue or the like.

The cuts 50 form end edges 55 to the outer end wall portion 48 which extend outwardly at an angle, illustrated at 56, relative to the respective edge 21 which is greater than 90° so that, as shown in FIG. 3, the outer portion 48 has the shape of a trapezoid. Angle 56 is preferably in the range of about 95° to 115°. For example, this angle 56 may perhaps be about 102°. The cuts 50 also provide end edges 58 to the inner wall portion 46 which edges 58 extend inwardly relative to the respective edge 21 from perforated line 40 to the terminal edge 42 thereby forming an angle, illustrated at 60, with the terminal edge 42 which is greater than 90°. This angle 60 between the end edge 58 and the terminal edge 42 is substantially equal to angle 56. Thus, when the second pair of side walls 18 are folded so that the inner and outer portions 46 and 48 respectively overlie each other, edges 58 and 55 will lie alongside each other so that the side walls 18 thus formed will have the shape of trapezoids. The crease lines 54 in the first pair of side walls 16 also extend outwardly relative to the respective edges 20 so as to form an angle, illustrated at 62, therewith which is also greater than 90° whereby the first pair of side walls 16 also have the shapes of trapezoids, the angle 62 being substantially equal to the angles 56 and 60. When the tray 12 is formed, each of the resulting trapezoidal-shaped walls inhibits the other walls from achieving an angle of 90° relative to the bottom wall 14 so that each of the side walls 16 and 18 slant outwardly from the bottom wall 14 at an angle, illustrated at 64 in FIGS. 4 and 5, which is substantially equal to angles 56, 60, and 62, yet a secure attachment of the walls to each other may be afforded thereby. This outward slope of the side walls permits nesting of the assembled trays 12 each partially inside the other to minimize the space required therefor within a pizza shop. This also allows the bottom wall 14 to be made slightly smaller for savings of material or allows a greater amount of available space for insertion of the side walls 28 of the lid 22 so that the possibility of interference by the lid with the pizza may be reduced.

A cut-out or slot 66 is provided generally centrally of the length of each of the second pair of side walls 18 beginning at the inner line of perforations 40 and is shown in FIGS. 1 to 5 as extending into the outer wall portion 48 over approximately half the height thereof, and corresponding in position and length to the tabs 32 to receive the tabs 32 in the slots 66 and between the inner and outer wall portions 46 and 48 respectively, as illustrated in FIG. 5. The extension of the slots 66 along the height of the outer wall portion 48 allows the tabs 32 to be easily inserted as well as gripped for easy removal of the lid from the tray. The tabs 32 are folded along lines 68 which are creased but non-perforated to allow the tabs 32 to have a spring effect and thereby bear against the outer wall portion 48, which spring effect is enhanced by the outwardly sloping side walls. This spring effect affords an increase in force against the outer side wall portion 48 when the upper wall of the lid is deflected inwardly, as illustrated at 70 in FIGS. 1 and 5, (such as by a person pushing inwardly on the center of the lid) so as to afford a resistance to such deflection to prevent the lid from caving in on the pizza and thereby eliminate the need for a plastic "barbie doll" table, an internal support which is sometimes provided in pizza boxes to prevent such an effect.

While a flat sheet of corrugated cardboard can generally be folded in half without a great deal of difficulty, the resistance thereof is greatly increased when the cardboard is provided in the shape of a tray with upstanding walls on each side. The large square shape of a pizza box is difficult to dispose of in a trash container or the like if it is not folded up. In order to allow the tray 12 to be easily folded in half for disposing thereof, in accordance with the present invention at least one fold line 72 is provided across the bottom wall 14 and extending beyond the bottom wall 14 through the height of the first pair of side walls, as illustrated in FIG. 3. In order to retain adequate strngth while also allowing ease of foldability, the fold line 72 is preferably a single line of perforations which is generally parallel to the edges 21 and generally midway between the edges 21 so that the tray 12 may be easily folded in half along the perforated line 72 for disposing thereof. The perforations are sized and spaced so as not to unduly sacrifice the strength of the bottom wall 14. For example, each of the perforations may have a length of perhaps about $\frac{3}{8}$ inch, and they may be spaced apart a distance equal to about $\frac{3}{8}$ inch. Other perforations in the container 10 may be similarly sized and spaced. Alternatively, the at least one fold line 72 may comprise a pair of fold lines each located a third of the distance across the bottom wall from the respective edge 21 whereby the tray may be folded in thirds, the fold line 72 may be provided from corner to corner of the tray, the fold line may be creased, or the fold line may comprise tear tape which is removable by pulling on a string.

For example, each of the legs 36 may be spaced a distance of perhaps 2 inches from the respective edge of the respective second side wall and extend over a length of perhaps of about $2\frac{1}{2}$ inches. Each of the legs may have a height of perhaps about $\frac{1}{4}$ inch. The tabs 44 may be similarly sized and have a depth of perhaps about $\frac{1}{4}$ inch. Each of the tabs 32 may have a length of perhaps about 3 inches and a width of perhaps about $1\frac{1}{2}$ inch, and each of the slots 66 may have a length of perhaps about 3 inches and extend over a height of perhaps about 1 inch. It should of course be understood that the present invention is not limited to such sizes and dimensions and may include other sizes and dimensions as may be suitable.

The container 10 may be constructed by first die-cutting with the cutting and perforating and creasing all being performed in the same die-cutting operation to form the blanks substantially as shown in FIGS. 2 and 3 for the lid 22 and the tray 12 respectively. The blanks are shipped to the pizza shop in that condition and are assembled at the pizza shop ideally during a slack period of time and stored in the limited space available until use thereof. In order to form the tray, the side walls are folded along the perforated bottom wall edges 20 and 21 into upstanding positions, and the second pair of side walls 18 are doubled over along the double perforated lines 38 and 40 so as to cause the inner portion 46 to overlie the outer portion. The first set of side walls are folded along crease lines 54, and the resulting end flaps 52 are inserted between the inner and outer portions 46 and 48 respectively. The tabs 44 are then snapped into the slots 34 to provide a secure tray which may be nested with other trays to save space within the pizza shop. The lids 22 may be stored as blanks. When it is time to use the container 10, the pizza is placed on the bottom wall 14, the lid is folded along perforated edges 26 and crease lines 68, and the resulting side walls 28 are inserted into the tray 12 to engage the inner surfaces of the first set of side walls 16 and the resulting tabs 32 inserted into the slots 66 and between the inner and outer portions 46 and 48 respectively to effect a secure attachment which is resistant to downward forces 70 on the lid so that the pizza is protected from such downward forces. When it is time to consume the pizza, the legs 36 conveniently allow the bottom wall 14 to be raised slightly above the surface of a table top so as to ensure against soiling of the table top and, if desired, the lid 22, which may be removed out of the way, may be placed under the tray 12. When it is time to dispose of the container after consumption of the pizza, the lid 22 may be easily folded and, since it is not soiled, may be placed into a bin for recycling. The tray 12 may be easily folded along the line of perforations 72 so that it may be easily disposed of.

Figure 7:
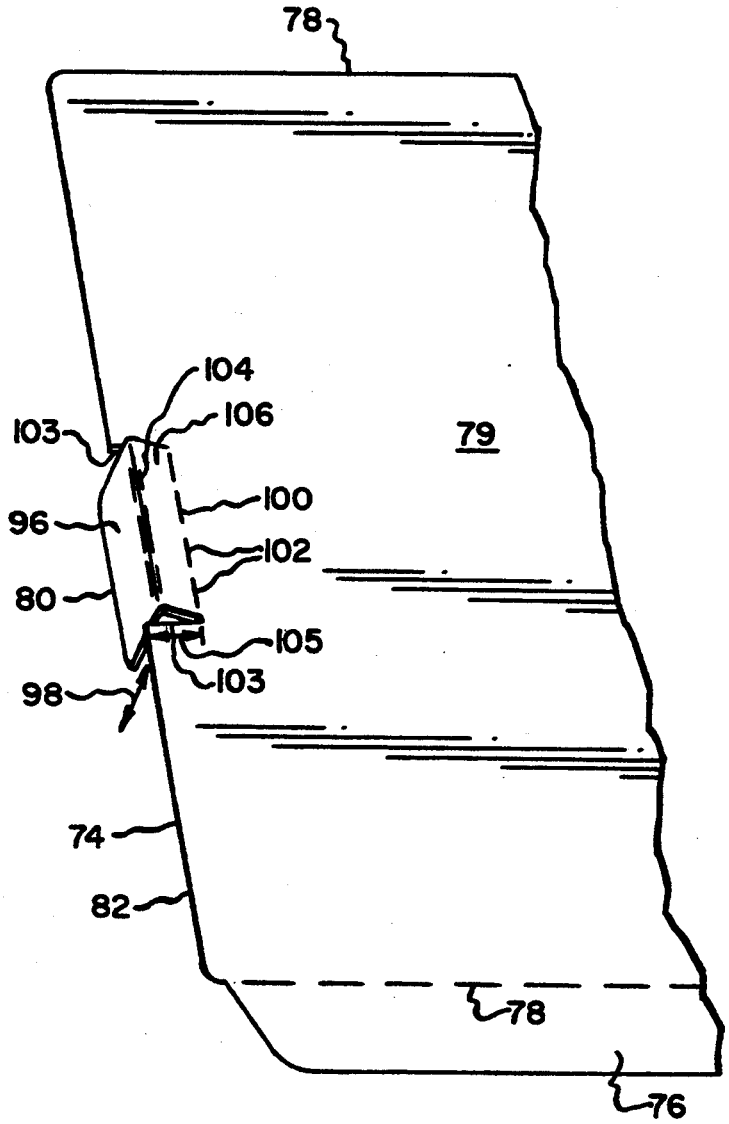
FIG. 7 is a partial perspective view of the lid for the container of FIG. 6.
Figure 6:
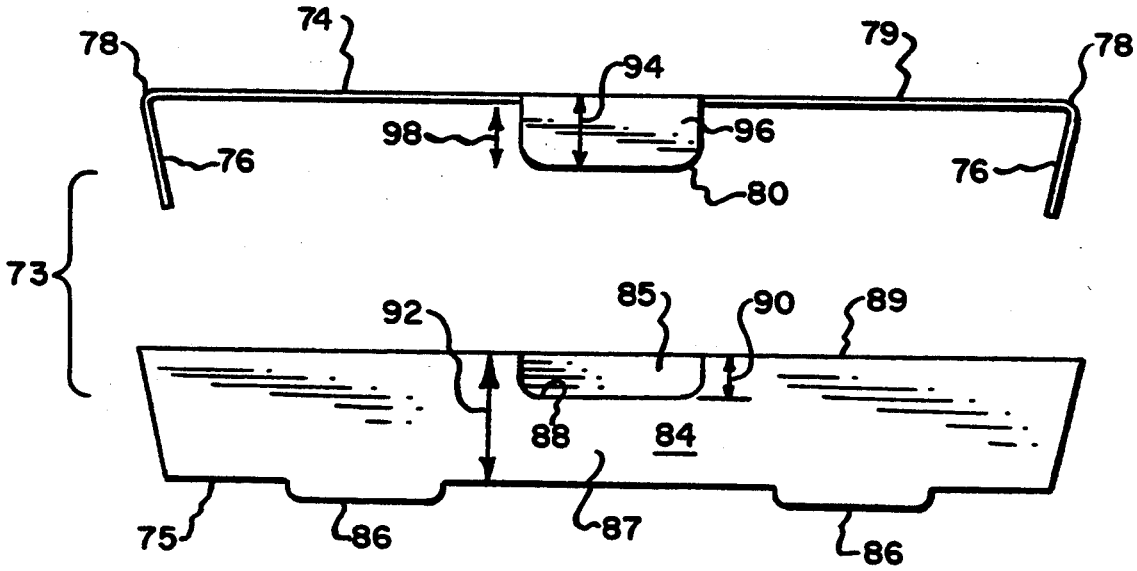
FIG. 6 is a view similar to that of FIG. 4 showing an alternative embodiment of the container.

Referring to FIGS. 6 and 7, there is illustrated at 73 a two-piece container including a base 75 and a lid 74. The lid 74 has a pair of identical opposite side walls 76 integrally and foldably connected to a pair of first opposite edges 78 of its generally rectangular upper wall 79 and a pair of identical tabs 80 integrally connected to a second pair of opposite edges 82. The base 75 has a first pair of opposite side walls (not shown), similar to side walls 16, and a second pair of opposite side walls 84 with identical legs 86 and cut-outs 88 thereon. Each side wall 84 has inner and outer wall portions 85 and 87 respectively integrally connected along fold line 89, the cut-out 88 being in the outer wall portion 87 and extending from the fold line 89 downwardly over a height which is illustrated at 90. With the exception of the tabs 80 and cut-outs 88, the container 70 is similar to container 10. Only one tab 80 and one cut-out 88 are shown, it being understood that the others thereof on the opposite edge and side wall respectively are identical.

In order to provide a more secure attachment of the lid 74 to the base 75, the height 90 of the cut-out 88 is reduced to less than about one-third of the height, illustrated at 92, of side wall 84. This also allows the height, illustrated at 94, of the insertion portion 96 of the tab 80 to also be reduced. For example, height 92 may perhaps be about $1\frac{7}{8}$ inch, height 90 may perhaps be about 9/16 inch, and height 94 may perhaps be about $1\frac{1}{8}$ inch.

As the cut-out height 90 is reduced, it becomes less easy to insert a tab such as tab 32 of the embodiment of FIGS. 1 to 5. In order that the tabs 80 may be inserted in and removed from the cut-outs 88 more easily, in accordance with the present invention the tab 80 is provided with the insertion portion 96 movable vertically, as illustrated at 98, into and out of the cut-out 88 with the base 75 and lid 74 held stationary. In order to provide such movement 98, the tab 80 is hingedly joined to the wall 79 along a hinge line, illustrated at 100, which is recessed inwardly of the respective edge 82 and parallel thereto and which preferably comprises a plurality of perforations 102, which may be similar to perforations 72. A pair of cuts, illustrated at 103, are made from the edge 82 into the wall 79 to the respectively opposite ends of the hinge line 100 to define the tab 80. The hinge line 100 may, for example, be recessed from the edge 82 a distance, illustrated at 105, which is equal to perhaps about $\frac{7}{8}$ inch. This distance 105 is preferably between about $\frac{1}{2}$ and 1 inch. The tab 80 is folded along fold line 104, which is preferably a crease line and which lies generally along or in line with the respective second edge 82, i.e., the crease line may be recessed slightly, perhaps about $\frac{1}{8}$ inch, from the edge 82. The crease line 104 defines the insertion portion 96 and a portion 106 which lies between the insertion portion 96 and the hinge line 100. The insertion portion 96 is generally normal to portion 106, i.e., it being understood that the angle between portions 96 and 106 will of course be varied as necessary for insertion of the insertion portion 96 into and its removal from between inner and outer wall portions 85 and 87 respectively at cut-out 88.

For attachment of the lid 74 to the base 75, the pair of lid side walls 76 are inserted into the base 75 adjacent the first pair of base side walls respectively. The insertion portions 96 may then be moved upwardly by hinged movement of portions 106 about the respective hinge lines 100 until the lower edges of the insertion portions 96 clear the lower edges respectively of the cut-outs 88. The insertion portions 96 are then pushed into engagement with the respective cut-outs 88 and pushed downwardly so as to lie between the inner and outer wall portions 85 and 87 respectively of the second base side walls resepctively, the portion 106 rotating about hinge line 100 so that it is generally co-planar with the lid wall 79. For removal of the insertion portion 96, frictional contact may be made by the fingers therewith for upward movement thereof until it clears the lower edge of cut-out 88 and disengages from the space between the inner and outer wall portions 85 and 87 respectively, the spring effect afforded by crease line 104 causing the insertion portion 96 to bear against the sloping outer wall portion 87 to effect resistance to downward force on the lid upper wall 79 for protection of pizza in the container.

Referring to FIGS. 8 and 9, there is illustrated at 110 an alternative embodiment of a bottom wall for the base 12 of FIGS. 1 to 5. The wall 110 has slots 112 similar to slots 34 and may have a fold line 114 similar to fold line 72, it being understood that the base may optionally be provided without fold line 114. It should be understood that the bottom wall 110 is part of a base which is otherwise similar to base 12 or to base 75.

In order to eliminate the need for single-face corrugated liner inserts while maintaining air circulation between the bottom wall 110 and a pizza thereon, in accordance with the present invention the bottom wall 110 is formed to have a plurality, generally over the entire surface, of raised portions 116 allowing air circulation, as illustrated at 118, under the pizza between the raised portions 116.

Referring to FIG. 9, the raised portions 116 are preferably formed in the corrugated cardboard from which the base including bottom wall 110 is formed by embossing during the die-cutting operation for cost effectiveness. The corrugated board 110 conventionally includes inner and outer liners or sheets 120 and 122 respectively of paper and a middle sheet or strip 124 of paper having elongate corrugations or flutes 126 disposed therebetween.

Referring to FIG. 10, in order to not have registration problems associated with rotary die cutters, the die cutter, illustrated at 128 in FIG. 10, is perferably of a high speed flat-bed type such as provided by Bobst Corporation of Lausanne, Switzerland. Such a die cutter has male and female cooperating dies 130 and 132 respectively. In the die shown in FIG. 10, the female die 132 is held stationary on a suitable support 134, the cardboard 110 is sandwiched between the dies, and the male die 130 is brought down onto the cardboard, as illustrated at 136, in registration with the female die 132 and with suitable force to emboss the cardboard 110 with the raised portions 116 as well as to suitably die-cut the cardboard to form the blank for the base. The male die 130 may, for example, contain $\frac{3}{8}$ inch wood or rubber dowels 138, and the female die 132 may be a board which is suitably ditched, as at 140. The tooling may desirably be coated with Teflon material or other suitable material which facilitates lubrication.

In order to reduce the likelihood of ripping of the cardboard during embossing, it is preferred that the elongate raised portions 116 extend in a direction across the flutes 126, i.e., in a direction generally normal to the direction the flutes extend, as shown in FIG. 9.

In order to allow two-directional air flow for more effective air circulation, the elongate raised portions 116 are preferably discontinuous across the bottom wall 110, i.e., two or mote spaced raised portions along a line rather than one single raised portion extending across the bottom wall. Thus, in FIG. 8, four spaced raised portions **116*a*, 116*b*, 116*c*, and 116*d*** are shown along a line across the bottom wall.

It is considered desirable to maximize the height, illustrated at 142, of the raised portions 116. A height 142 of, for example, 0.05 inch is considered satisfactory. The height 142 should preferably be at least about 0.02 inch for suitable air circulation. It has been found that the height 142 can be increased by reducing the number of raised portions. For example, the bottom wall 110 may perhaps be 15 inches square, have raised portions 116 as shown in FIG. 8 to a height 142 of perhaps about 0.06 inch, each raised portion 116 having a length of perhaps about $2\frac{1}{2}$ inches and a width of perhaps about $\frac{1}{2}$ inch. Of course, other suitable patterns of raised portions 116 may be provided in accordance with principles commonly known to those of ordinary skill in the art to which this invention pertains.

The cardboard for the base is chemically treated for cheese release, to prevent damage from pizza vapor soaking through, and to maintain a pleasing appearance. A suitable chemical, which as been used to treat the single-face inserts, is one identified as FC807, provided by Minnesota Mining and Manufacturing Company of St. Paul, Minn.

An advantage of the two-piece box of the present invention is that it is unnecessary to chemically treat the lid whereby additional cost savings may be achieved. Thus, for example, chemical treatment may perhaps cost about 0.25 cent per box and the embossing may perhaps cost about 0.18 cent per box to eliminate the insert which may perhaps cost about 3 cents per box.

The chemical treatment cost would of course be higher if the lid had to also be treated.

It is also considered desirable to improve the aesthetics by preventing pizza vapor from accumulating on the bottom wall. In order to prevent such pizza vapor accumulation, a plurality of small apertures, illustrated at 144, are provided in the inner liner 120 (only a sample thereof shown in FIG. 8) to allow air flow of the vapor into the space, illustrated at 145, between the inner and outer liners 120 and 122 respectively. These apertures 144 may perhaps be the size of pinholes (perhaps about 1/64 inch diameter) and have a spacing of perhaps between $\frac{1}{8}$ and $\frac{1}{4}$ inch over the area of the bottom wall 110. If desired, the raised portions may not be provided with such apertures.

The features of the two-piece corrugated cardboard construction, the sloping side walls, the insertion of the tabs 32 or 80 between the inner and outer portions of the pair of second base side walls respectively, the line of perforations 72 for folding the tray, and the raised bottom wall portions for affording air circulation advantageously relate to each other so as to provide what might be called a "symphony" of interrelated inventive features for providing an inexpensive, reliable, and easy to use pizza box.

It should be understood that while the invention has been described in detail herein, the invention can be embodied otherwise without departing from the principles thereof. For example, as appropriate, fold lines which are described herein as being perforated may instead be creased, and those described as creased may instead be perforated. Such other embodiments are meant to come within the scope of the present invention as defined by the appended claims.

What is claimed is:

1. A two-piece container comprising a base and a lid, said lid comprising a generally rectangular wall having a pair of opposite first edges and a pair of opposite edges, each of said second edges having at least one tab, means for hingedly joining at least one of said tabs to said lid along a respective hinge line recessed inwardly from said respective second edge, said a least one of said tabs being folded along a respective fold line lying generally along said respective second edge to define a respective insertion portion and a respective portion which lies between the respective insertion portion and the respective hinge line and which is generally normal to the respective insertion portion, said base comprising a generally rectangular bottom wall, a pair of outwardly sloping opposite first side walls, a pair of outwardly sloping opposite second side walls, and means defining at least one cut-out in each of said second side walls for receiving the respective one of said tabs with the insertion portion of said at least one of said tabs received in said respective cut-out means.

2. A container according to claim 1 wherein said bottom wall has a first and a second pair of opposite edges, said first side walls being foldably connected to said bottom wall along said first pair of opposite edges respectively of said bottom wall, each of said first side walls including a pair of end flaps, said second side walls being foldably connected to said bottom wall along said second pair of opposite edges respectively of said bottom wall, each of said second side walls having fold-line means about which said respective second side wall is foldable to define inner and outer wall portions respectively and to position an edge of said respective second side wall adjacent said bottom wall, the container further comprising at least one tab extending from the edge of each of said second side walls, slot means in said bottom wall for receiving said base tabs respectively, each of said flaps being receivable between said inner and outer wall portions of said respective second side wall of said base, and said inner and outer wall portions each having a shape of a trapezoid to effect the outward slope to the first and second pairs of side walls.

3. A container according to claim 1 wherein said hingedly joining means comprises a line of perforations extending between a pair of cuts extending from said respective lid second edge inwardly of said lid.

4. A container according to claim 2 wherein each of said cut-out means extends from respective one of said second side wall fold-line means into respective one of said outer wall portions a distance equal to less than about one-third of the height of said respective outer wall portion.

5. A container according to claim 1 further comprising a pair of opposite side walls foldably attached to said first edges respectively of said lid for engaging inner surfaces of said first side walls respectively of said base.

6. A container according to claim 1 wherein said base and said lid are composed of corrugated cardboard.

7. A container according to claim 6 wherein each of said bottom wall and said lid generally rectangular wall is square, said base further comprising fold-line means in said bottom wall and said first base side walls midway between said second base side walls for folding the base in half for disposal.

8. A container according to claim 2 wherein each of said first base side walls has a shape of a trapezoid.

9. A container according to claim 1 further comprising a plurality of raised bottom wall portions for circulating air under a pizza which is received on said bottom wall.

10. A container for pizza, the container comprising a bottom wall composed of corrugated board having corrugations for receiving pizza, a plurality of side walls, a lid, and means comprising a plurality of raised bottom wall portions die embossed in said bottom wall for circulating air under a pizza.

11. A container according to claim 10 wherein said raised bottom wall portions are discontinuous across said bottom wall to allow two-dimensional air flow.

12. A container according to claim 10 wherein the container is a two-piece container wherein said bottom wall and said plurality of side walls comprise a base.

13. A container according to claim 12 wherein the base includes means for providing a cheese release and grease barrier.

14. A container according to claim 12 further comprising fold-line means in said bottom wall and a pair of opposite ones of said side walls for folding the base in half for disposal.

15. A container for pizza, the container comprising a bottom wall for receiving pizza, a plurality of side walls, a lid, and means comprising a plurality of raised bottom wall portions for circulating air under a pizza, said bottom wall is composed of cardboard having corrugations, and said raised bottom wall portions are elongate and extend in a direction across said corrugations.

16. A container according to claim 15 wherein said raised bottom wall portions are embossed on said bottom wall.

17. A container for pizza, the container comprising a bottom wall for receiving pizza, a plurality o side walls, a lid, and means comprising a plurality of raised bottom wall portions for circulating air under a pizza, wherein said bottom wall is composed of corrugated board comprising an inner liner of paper for contacting pizza in the container, an outer liner of paper, and a middle sheet of paper which is corrugated, the container further comprising aperture means in said inner liner for routing vapor from a pizza to a space between said inner and outer liners.

18. A container according to claim 17 wherein said raised bottom wall portions are embossed in said bottom wall.

19. A container according to claim 18 wherein said raised bottom wall portions are elongate and extend in a direction across said corrugations.

20. A base for a two-piece container for pizza, the base comprising a bottom wall composed of corrugated board having corrugations for receiving pizza, a plurality of side walls, and means comprising a plurality of raised bottom wall portions die embossed in said bottom wall for circulating air under a pizza.

21. A base according to claim 20 wherein said raised bottom wall portions are discontinuous across said bottom wall to allow two-dimensional air flow.

22. A base according to claim 20 wherein said raised bottom wall portions are elongate and extend in a direction across said corrugations.

23. A base according to claim 20 wherein said bottom wall comprises an inner liner of paper for contacting pizza in the container, an outer liner of paper, and a middle sheet of paper which is corrugated, the base further comprising aperture means in said inner liner for routing vapor from a pizza to a space between said inner and outer liners.

24. A two-piece container comprising a base and a lid, said lid comprising a generally rectangular wall having a pair of opposite first edges and a pair of opposite second edges, each of said second edges having at least one tab, means for hingedly joining at least one of said tabs to said lid along a respective hinge line recessed inwardly from said respective second edge, said at least one of said tabs being folded along a respective fold line which lies generally along said respective second edge to define a respective insertion portion and a respective portion which lies between the respective insertion portion and the respective hinge line and which is generally normal to the respective insertion portion, said base comprising a generally rectangular bottom wall, a pair of outwardly sloping opposite first side walls, a pair of outwardly sloping opposite second side walls, each of said second side walls having fold-line means about which said respective second side wall is folded to define inner and outer wall portions, means for securing said respective inner wall portion alongside said respective outer wall portion, and means defining at least one cut-out in each of said second side walls for receiving a respective one of said tabs between said respective inner and outer wall portions with the insertion portion of said at least one of said tabs received in said respective cut-out means.

25. A container according to claim 24 wherein said hingedly joining means comprises a line of perforations extending between a pair of cuts extending from said respective lid second edge inwardly of said lid.

* * * * *

UNITED STATES PATENT AND TRADEMARK OFFICE

CERTIFICATE OF CORRECTION

PATENT NO. : 5,402,930

DATED : April 4, 1995

INVENTOR(S) : Brian H. Storms, David W. Spitz, and Walter F. Mikus

It is certified that error appears in the above-identified patent and that said Letters Patent is hereby corrected as shown below:

Column 9 line 42 (in claim 1) "said a least" should be "said at least"

Column 10 lines 15 & 16 (claim 4) "from respective" should be "from a respective"

"into respective" should be "into a respective"

Claim 17 Column 11 line 2 "o" should be "of"

Signed and Sealed this

Fourth Day of July, 1995

Bruce Lehman

*Attest:*

BRUCE LEHMAN

*Attesting Officer*

*Commissioner of Patents and Trademarks*